US007320528B2

(12) United States Patent
Götz

(10) Patent No.: US 7,320,528 B2
(45) Date of Patent: Jan. 22, 2008

(54) REFRIGERATOR WITH INTERIOR LIGHTING

(75) Inventor: Bernhard Götz, Zaisenhausen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 51 days.

(21) Appl. No.: 10/566,380

(22) PCT Filed: Aug. 10, 2004

(86) PCT No.: PCT/EP2004/008953

§ 371 (c)(1),
(2), (4) Date: Jan. 26, 2006

(87) PCT Pub. No.: WO2005/017428

PCT Pub. Date: Feb. 24, 2005

(65) Prior Publication Data

US 2007/0115649 A1 May 24, 2007

(30) Foreign Application Priority Data

Aug. 11, 2003 (DE) ..... 103 36 833

(51) Int. Cl.
*F21W 131/305* (2006.01)

(52) U.S. Cl. ..... 362/94; 362/92; 362/155; 362/253

(58) Field of Classification Search ..... 362/92, 362/94, 154, 155, 127, 133, 253, 362, 373
See application file for complete search history.

(56) References Cited

U.S. PATENT DOCUMENTS

| | | | | |
|---|---|---|---|---|
| 2,148,787 | A * | 2/1939 | Thomas | 362/94 |
| 2,438,972 | A | 4/1948 | Hoffman | |
| 4,754,376 | A | 6/1988 | Winslow | |
| 5,937,666 | A | 8/1999 | Trulaske, Sr. | |
| 6,935,327 | B1 * | 8/2005 | Williams et al. | 126/39 BA |
| 7,157,667 | B2 * | 1/2007 | Gramlich et al. | 219/391 |

* cited by examiner

*Primary Examiner*—Laura Tso
(74) *Attorney, Agent, or Firm*—Russell W. Warnock; James E. Howard

(57) ABSTRACT

A refrigerator including a body and a door pivotably fitted to the body. The body and the door together define an interior space in the refrigerator. At least one lamp for illumination of the interior is mounted on the door and the light distribution thereof, relative to the door, is variable and coupled to the pivot motion of the door.

8 Claims, 3 Drawing Sheets

REFRIGERATOR WITH INTERIOR LIGHTING

The present invention relates to a refrigerator comprising a body and a door fitted to the body such as to pivot, which jointly define an interior which can be illuminated by at least one lamp.

In most refrigerators such a lamp is attached to an inner side wall of the body. The illumination of the interior which can be achieved with such a lamp is frequently unsatisfactory because items to be cooled accommodated in the vicinity of the lamp tend to shade large areas of the interior so that the viewing conditions there are poor. Since items to be cooled placed near the door should be illuminated, it is almost unavoidable that the lamp also emits in the direction of the door whereby a user can be dazzled.

In order to avoid any dazzling of a user, it is desirable to place the lamp as near as possible to the door so that it can be completely covered towards the door, thus avoiding any risk of dazzle and despite this all objects in the interior of the refrigerator (provided that they are not covered by others) can be illuminated. Thus, for example, refrigerators are known wherein such interior lighting is not accommodated in the interior itself but on the underside of a control panel which forms the upper front termination of the housing and when the door is closed, this underside lies opposite to an upper flank of the door. However, with such a lamp it is difficult to satisfactorily illuminate the upper rearward area of the interior.

It is the object of the present invention to provide a refrigerator which ensures uniform illumination of the interior with a minimum of shadow which impairs the visibility of objects in the interior and freedom from glare as far as possible. The object is solved by a refrigerator having the features described and claimed herein. The attached of the at least one lamp on the door of the refrigerator has the result that, when the door is open, this illuminates the interior through the open front side, largely parallel to the viewing direction of the user. The risk of any dazzling of the user is eliminated by the extensive parallelism and in addition, the shadows of objects illuminated by the lamp in the interior are located substantially behind these objects, also relative to the viewing direction of the user and thus only substantially darken objects which are otherwise largely covered by items in front thereof. As a result of the light distribution produced by the lamp being coupled to the pivoting movement of the door, such good illumination can be achieved largely independently of the opening angle of the door. It is also possible to align the interior of the refrigerator over the entire interior height by means of a corresponding arrangement of the lamp in the door and by means of a specific construction of the emission characteristics and/or a reflector.

The coupling between the pivoting movement of the door and the variation in the light distribution of the lamp associated therewith is preferably of a mechanical nature.

The variation of the light distribution associated with the pivoting of the door preferably includes a rotation of the direction of highest-intensity emission by the lamp in a direction opposite to the pivoting movement of the door so that when the door is pivoted about a given angle, the direction of highest-intensity emission does not turn relative to the body of the refrigerator or at most by a smaller angle that the pivot angle of the door.

Alternatively or additionally, the coupling can also have the result that the light distribution of the lamp has a width which decreases with increasing opening angle of the door, i.e. that the light distribution is more strongly focussed, the wider the door is opened. This takes into account the fact that as a result of the opening of the door, the lamp generally also moves away from the interior to be illuminated.

The variation of the light distribution relative to the door can be achieved, for example by means of a reflector of the lamp which can be moved relative to the light source of the lamp coupled to the pivoting movement of the door. Alternatively or additionally, it is also possible to provide a refractive element which can be moved relative to the light source coupled to the pivoting movement of the door. The light source as a whole can also be arranged pivotally on the inner surface of the door.

In order to prevent the door itself shading a part of the interior when the door is opened at right angles, the lamp should project over an inner surface of the door at least when the door is opened.

Further features and advantages of the invention are obtained from the following description of the exemplary embodiments with reference to the appended figures. In the figures.

Figure 1:
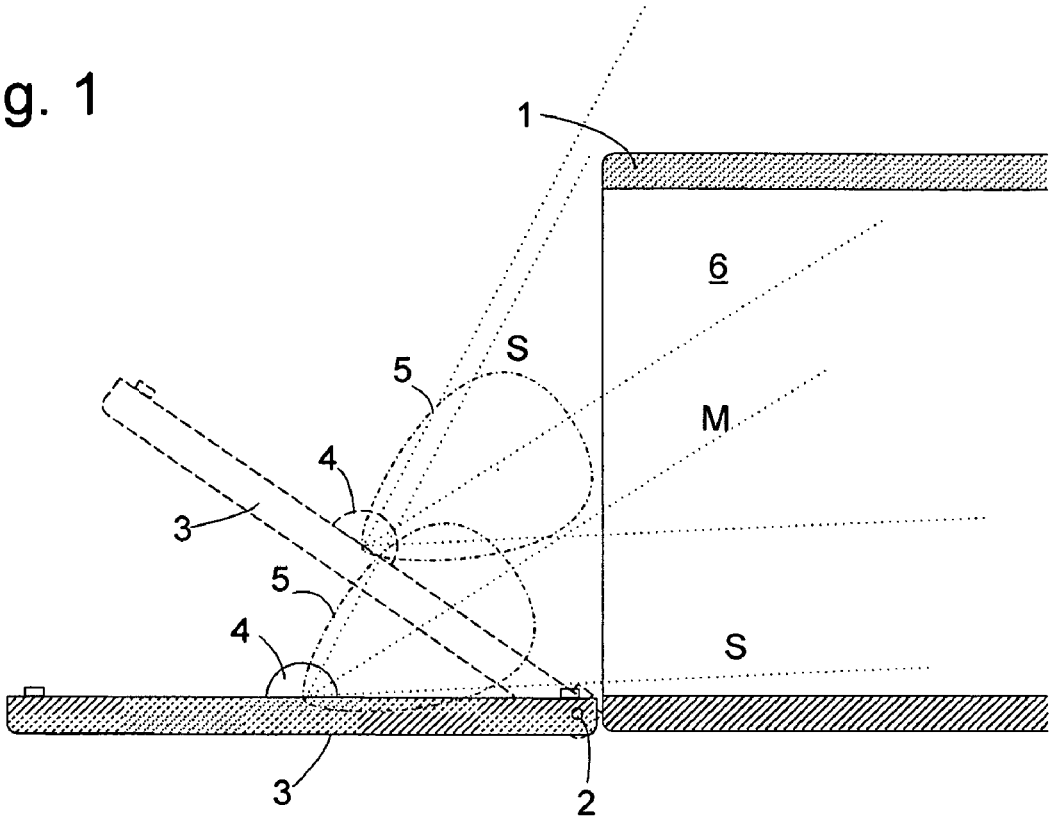
FIG. 1 is a schematic horizontal section through the front area of a refrigerator according to the invention with the door completely or partly open.

FIG. 1 shows, in a horizontal section, the front area of the body 1 of a refrigerator and a door 3 connected thereto by means of a hinge 2 in a half-open and a fully open position. Located centrally on the inside of the door 3 is a lamp 4 whose emission characteristic having a principal direction of emission M, shown as a lobe-shaped curve 5, can be pivoted relative to the door 3 coupled to its rotation in the hinge 2 so that it retains its spatial orientation when opening and closing the door 3. Regardless of the degree of opening of the door 3, the light of the lamp 4 is thus always directed into the interior 6 of the refrigerator and illuminates objects placed therein from the front without dazzling a user. In this case, the principal direction of emission M of the lamp 4 is directed into the interior approximately at the same angle of incidence relative to the opening plane of the interior of the refrigerator regardless of the opening angle of the door 3.

Figure 2:
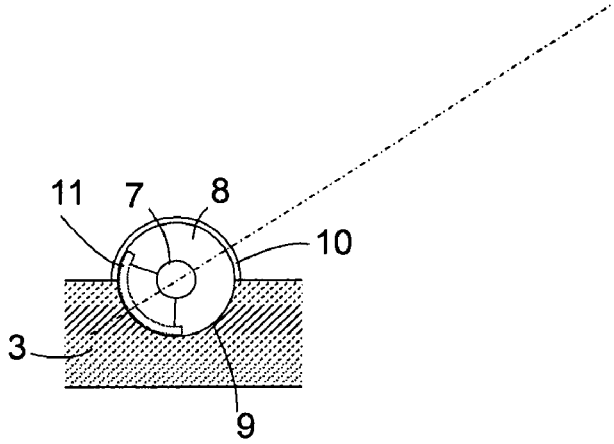
FIG. 2 is a schematic section through a first embodiment of a lamp mounted on the door of the refrigerator.

FIG. 2 shows an example of the structure of the lamp 4 in a horizontal section parallel to the plane of intersection in FIG. 1. A tubular light source 7, e.g. a compact fluorescent tube, is accommodated centrally in a chamber 8 which extends vertically on the inside of the door 3. Walls of the chamber are formed on the one hand by cylindrical-segment-shaped recess 9 of the door 3 and on the other hand by a transparent hood 10 of glass or plastic. A cylindrical-segment-shaped reflector 11 is rotatably disposed inside the chamber 8.

Figure 3:
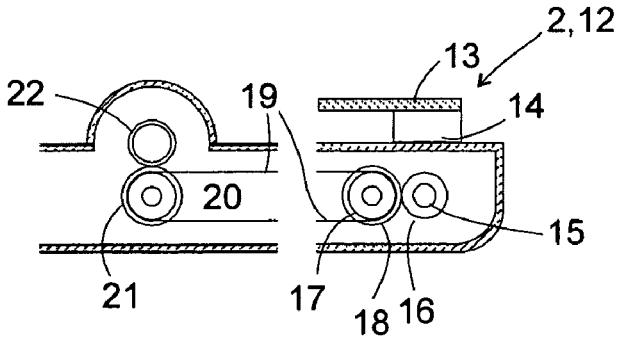
FIG. 3 is an example of a coupling mechanism for driving a rotation of the lamp coupled to the opening and closing of the door.

The rotation of the reflector 11 is driven by a mechanism shown schematically in FIG. 3, which is accommodated in a flat cavity respectively at the upper and lower end of the door 3.

The hinge 2 is formed in a fashion known per se by a metal fitting 12 comprising a plate 13 screwed to the body 1, a horizontal arm 14 and bearing pin 15 projecting from the arm 14. When mounting the door 3 on the body 1, this bearing pin 15 is pressed positively and non-positively into a sleeve 16 which cooperates as a friction wheel with a second friction wheel 18 constructed in one piece with a pulley 17. The pulley 17 couples by means of a belt 19 to a second pulley 20 which is in turn integrally associated with a friction wheel 21 which drives a wheel 22 arranged coaxially to the light source 7 carrying the reflector 11. Since the pulleys 17, 20 and the friction wheels 18, 21 integrally cohesive therewith are of the same design and the sleeve 16 and the wheel 22 have the same outside diameter, on each rotation of the door 3 in the hinge 2, the reflector 11 turns through the same angle opposite to the angle of rotation of the door so that the direction of maximum light current in the beam characteristic of the lamp 4 designated by M in FIG. 1 does not change relative to the body 1 of the refrigerator.

The light source 7 can be arranged slightly outside the central pivot point of the reflector 11 so that as the opening angle of the door 3 increases—and in consequence the distance of the light source 7 from the interior 6 to be illuminated increases—the focussing of the light by the reflector 11 becomes stronger.

Naturally, the friction wheels of the coupling mechanism in FIG. 3 can also be replaced by gear wheels.

Figure 4:
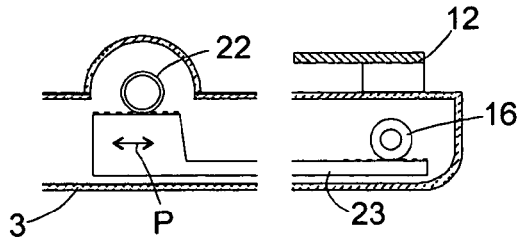
FIG. 4 is a second example of a coupling mechanism in a section similar to FIG. 2.

FIG. 4 shows a second embodiment of a coupling mechanism. In this embodiment the elements 17 to 21 from FIG. 3 are replaced by a rack 23 which is displaceable, guided by rails, in the cavity of the door 3 in directions designated by a double arrow P and meshes with teeth on the sleeve 16 and the wheel 22. The action of the coupling mechanism is the same as in the mechanism from FIG. 3.

Figure 5:
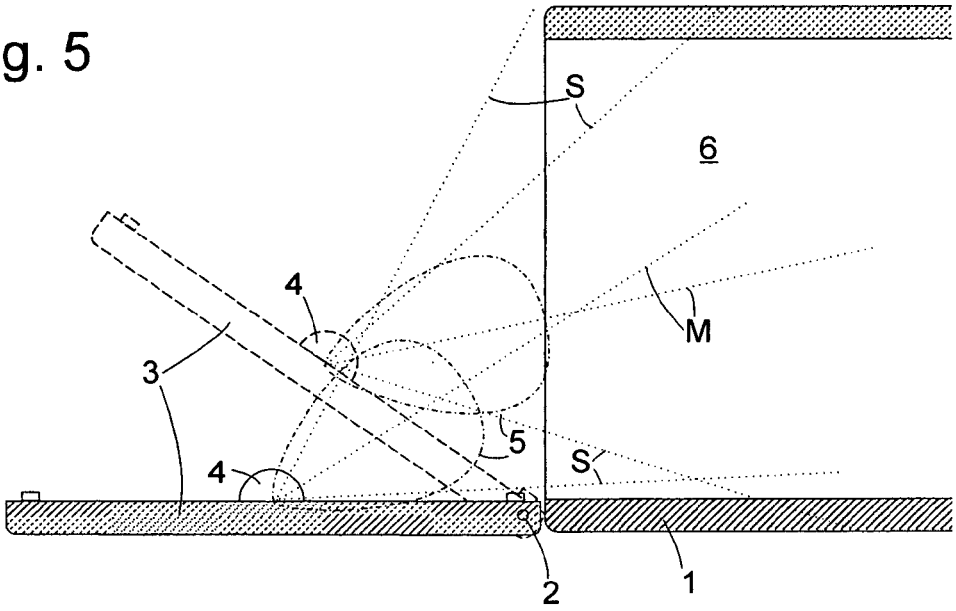
FIG. 5 is a second example of a refrigerator in a horizontal section similar to FIG. 1.

FIG. 1 shows the door 3 once in a fully open position, shown by continuous lines, pivoted through 90° with respect to the closed position (not shown) and once, shown by dashed lines, in a half-open position. Directions of the beam characteristic 5 where the light flux has fallen to a certain percentage, e.g. 50% of the maximum light flux are designated by S in the figure. In the fully open position the interior 6 of the refrigerator lies almost completely between the two lines S. Thus, the entire interior is well and uniformly illuminated. In the half-open position however, a considerable part of the interior 4 no longer lies between the two lines S and is therefore only poorly illuminated. In order to achieve good illumination of the interior regardless of the degree of opening of the door 3, on opening the door 3, the beam characteristic 5 is made to rotate somewhat more slowly than the door 3 itself, as is shown using the horizontal section in FIG. 5. That is, whereas in the embodiment in FIG. 1, the rotation of the door 3 in the hinge 2 is translated into a rotation of the reflector 11 in a ratio of 1:1, in the embodiment in FIG. 5, the rotation of the reflector is smaller than that of the door. In order to achieve this, the diameter of the wheel 22, for example, can be selected to be somewhat larger than that of the sleeve 16. Thus, the interior 6 is uniformly illuminated even when the door is partly open.

Figure 6:
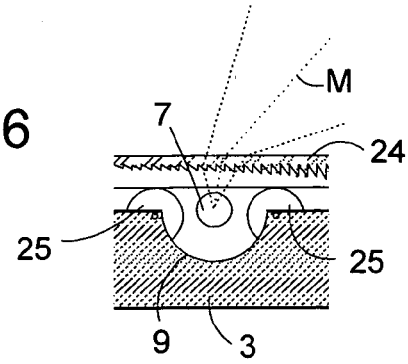
FIG. 6 is a schematic section through a further embodiment of a lamp.

FIG. 6 shows a second embodiment of a lamp for the refrigerator according to the invention. As in the case of the lamp from FIG. 2, a vertically arranged tubular light source 7 is provided which is placed before a semi-cylindrical recess 9 on the inside of the door 3. The inner surface of the recess can be reflection-coated to form a reflector but this reflector is not movable. Instead of this, the light source 7 is covered by a transparent screen 24 which is held displaceably in rails parallel to the door 3 and is driven by wheels 25 coupled to the sleeve 16. These wheels 25 translate each pivoting movement of the door into a displacement of the screen 24 parallel to the door inner side. The screen 24 is composed of a plurality of vertically oriented prisms which are formed so that their deflecting effect on light beams emitted by the light source (shown as dashed lines in FIG. 6) becomes stronger with increasing displacement of the screen 24 to the left. That is, the further the door 3 is opened, the further the screen 24 must be displaced to the left so that the interior 6 of the refrigerator is illuminated correctly and uniformly every time. In this embodiment the relationship between the rotation of the door and a rotation of the principal direction of emission M of the lamp depends not only on a transmission ratio of a mechanism coupling wheels 25 to the sleeve 16 but also on the orientations of the entry faces of the individual prisms, which in principle can be arbitrarily selected. In this embodiment the transmission ratio between the rotation of the door 3 and the rotation of the principal direction of emission 11 can be made variable as a function of the opening angle of the door 3 by suitably selecting the shape of the prisms if this is required to achieve optimal illumination.

Figure 7:
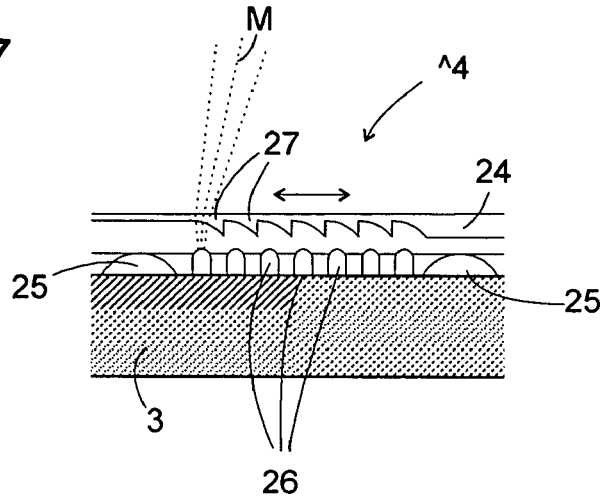
FIG. 7 is a further embodiment of a lamp.

FIG. 7 shows a third embodiment of a lamp in a section similar to that of FIGS. 2 and 6. In this case, the lamp has a plurality of white light-emitting diodes 26 as light sources which each emit a focussed light beam as indicated by dashed lines in the figure. The light-emitting diodes 26 can be arranged above one another in a plurality of vertical rows, only one light-emitting diode 26 from each row being shown in the figure. As in the lamp from FIG. 6, a screen 24 driven by wheels 25 coupled to the sleeve 16, which can be displaced parallel to the inside of the door 3 is arranged in front of the light-emitting diodes 26. A cylindrical lens segment 27 is formed in the screen 24 before each row of light-emitting diodes 26. In this embodiment a lateral freedom of movement of the screen 24 of not more than the width of a cylindrical lens segment 27 is sufficient to pivot the principal direction of emission M of the lamp 4 as a function of the movement of the door 3 so far as to always ensure optimal illumination of the interior 6.

Figure 8:
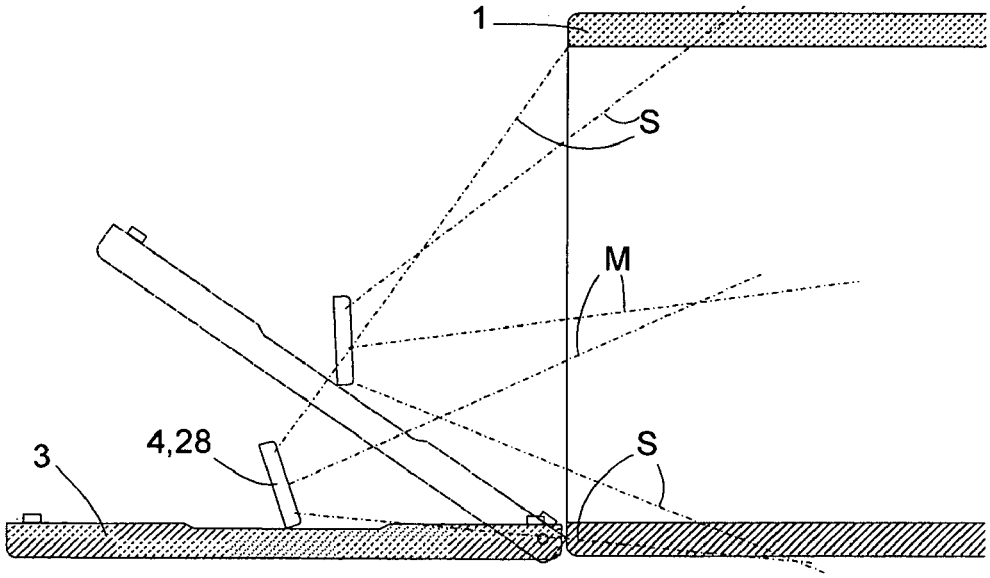
FIG. 8 is a section through a third embodiment of a refrigerator according to the invention.

In the embodiment in FIG. 8 the lamp 4 is formed by a plate-like support 28 equipped with a large number of discrete light-emitting diodes or with one or a plurality of large-area OLEDs. This support 28 is pivotally connected to the inner surface of the door 3 at one of its longitudinal edges and is coupled to the pivoting movement of the door 3 by means of a coupling mechanism of the type shown in FIG. 3 or FIG. 4. When the door is closed, the support 28 lies flat on the inner surface of the door 3 and thus takes up only a minimal amount of space in the interior. When the door is opened, the support pivots out as shown in the figure. The support 28 at a distance from the inside of the door 3 in particular makes it possible to efficiently illuminate the edge zone of the interior 6 adjacent to the hinge 2 even when the door 3 is open at right angles.

The invention claimed is:

1. A refrigerator comprising:

a body;

a door pivotably fitted to said body;

said body and said door jointly defining an interior of the refrigerator; and at least one lamp having a light distribution for illuminating said interior, said lamp mounted on said door and said light distribution relative to said door is variable and coupled to the pivoting movement of said door.

2. The refrigerator according to claim 1, including said variable coupling and said light distribution is mechanical.

3. The refrigerator according to claim 1, including said light distribution has a direction (M) of highest-intensity emission which is pivoted in a direction opposite to said pivoting movement of the door.

4. The refrigerator according to claim 3, including the transmission ratio of said light distribution compensates for that of said door position at most angles of said pivoting movement of said door.

5. The refrigerator according to claim 1, including said lamp having a light source and a refractive element which can be moved towards one another coupled to said pivoting movement of said door.

6. A refrigerator comprising:

a body;

a door pivotably fitted to said body;

said body and said door jointly defining an interior of the refrigerator; and at least one lamp having a light distribution for illuminating said interior, said lamp mounted on said door and said light distribution relative to said door is variable and coupled to the pivoting movement of said door in a manner in which said light distribution has a width which decreases as the opening of said door increases.

7. A refrigerator comprising:

a body;

a door pivotably fitted to said body;

said body and said door jointly defining an interior of the refrigerator; and at least one lamp having a light distribution for illuminating said interior, said lamp mounted on said door and said light distribution relative to said door is variable and coupled to the pivoting movement of said door, with said lamp having a light source and a reflector which can be moved towards one another coupled to said pivoting movement of said door.

8. A refrigerator comprising:

a body;

a door pivotably fitted to said body;

said body and said door jointly defining an interior of the refrigerator; and at least one lamp having a light distribution for illuminating said interior, said lamp mounted on said door and said light distribution relative to said door is variable and coupled to the pivoting movement of said door, and said lamp projecting over an inner surface of said door at least when said door is opened.

* * * * *